US006772549B2

(12) United States Patent
Muhlestein

(10) Patent No.: US 6,772,549 B2
(45) Date of Patent: Aug. 10, 2004

(54) FIREARM LEVELER AND STABILIZER

(76) Inventor: Todd J. Muhlestein, P.O. Box 137, Oakley, ID (US) 83346

( * ) Notice: Subject to any disclaimer, the term of this patent is extended or adjusted under 35 U.S.C. 154(b) by 0 days.

(21) Appl. No.: 09/882,212

(22) Filed: Jun. 15, 2001

(65) Prior Publication Data

US 2002/0040544 A1 Apr. 11, 2002

Related U.S. Application Data

(60) Provisional application No. 60/212,110, filed on Jun. 15, 2000.

(51) Int. Cl.[7] ..... F41C 23/02
(52) U.S. Cl. ..... 42/94; 224/150
(58) Field of Search ..... 42/94, 90; 224/149, 224/150

(56) References Cited

U.S. PATENT DOCUMENTS

| | | | | | |
|---|---|---|---|---|---|
| 1,406,827 | A | * | 2/1922 | Dumas | 42/94 |
| 2,472,804 | A | * | 6/1949 | Bird | 42/72 |
| 2,489,283 | A | * | 11/1949 | Garand | 42/94 |
| 2,807,904 | A | * | 10/1957 | Kreske | 42/94 |
| 2,991,579 | A | | 7/1961 | Lies | 42/94 |
| 3,012,350 | A | | 12/1961 | Wold | 42/94 |
| 3,041,938 | A | | 7/1962 | Seabrook | 89/37 |
| 3,827,172 | A | * | 8/1974 | Howe | 42/94 |
| 4,007,554 | A | | 2/1977 | Helmstadter | 42/94 |
| 4,026,057 | A | | 5/1977 | Cady | 42/94 |
| 4,333,385 | A | | 6/1982 | Culver | 89/37 BA |
| 4,393,614 | A | | 7/1983 | Pickett | 42/94 |
| 4,625,620 | A | | 12/1986 | Harris | 89/37.04 |
| 4,854,066 | A | | 8/1989 | Canterbury, Sr. | 42/94 |
| 4,873,777 | A | | 10/1989 | Southard | 42/94 |
| 4,967,497 | A | | 11/1990 | Yakscoe | 42/94 |
| 4,972,619 | A | * | 11/1990 | Eckert | 42/94 |
| 4,987,694 | A | | 1/1991 | Lombardo | 42/94 |
| 5,029,407 | A | | 7/1991 | Kirkpatrick | 42/94 |
| 5,081,782 | A | | 1/1992 | Wright | 42/94 |
| 5,110,022 | A | * | 5/1992 | Dvoroznak et al. | 224/150 |
| 5,345,706 | A | * | 9/1994 | Brown | 42/94 |
| 5,347,740 | A | | 9/1994 | Rather et al. | 42/94 |
| 5,617,666 | A | | 4/1997 | Scott | 42/94 |
| 5,628,135 | A | | 5/1997 | Cady | 42/94 |
| 5,811,728 | A | | 9/1998 | Maeda | 174/65 R |
| 5,903,995 | A | * | 5/1999 | Brubach | 42/90 |
| 5,913,668 | A | * | 6/1999 | Messer | 42/94 |
| 5,937,560 | A | | 8/1999 | Beltz | 42/94 |
| 6,029,386 | A | | 2/2000 | Globig | 42/94 |
| 6,305,116 | B1 | * | 10/2001 | Parker | 42/94 |

* cited by examiner

*Primary Examiner*—Michael J. Carone
*Assistant Examiner*—Gabriel S. Sukman
(74) *Attorney, Agent, or Firm*—Kunzler & Associates

(57) ABSTRACT

The invented firearm leveler-stabilizer reduces rifle movement to improve projectile accuracy by using an adjustable elongated member connected to the bottom surface of a gun buttstock. A turnbuckle provides an adjustment means for extremely precise leveling of the firearm's barrel while a foot pad rests upon a supporting surface to increase stability during recoil, and while the front of the firearm preferably rests on a bi-pod or other support. A swivel at one end of the leveler-stabilizer connects to a buttstock mount, and a foot pad at the other end of the leveler-stabilizer rests on the ground. In between the two ends is a turnbuckle which provides a means to adjust buttstock elevation extremely accurately for targeting. This foot pad may have an optional sling attachment point. The leveler-stabilizer pivots to against the firearm for transport or storage. The leveler-stabilizer is particularly effective near the rear of the gun and the additional use of a front pod unit, that is, a monopod, bipod or tripod at a point forward of the receiver, so that, as the rear leveler-stabilizer moves the rear of the firearm up or down, the front of the firearm pivots on the front pod unit.

10 Claims, 6 Drawing Sheets

Figure 2
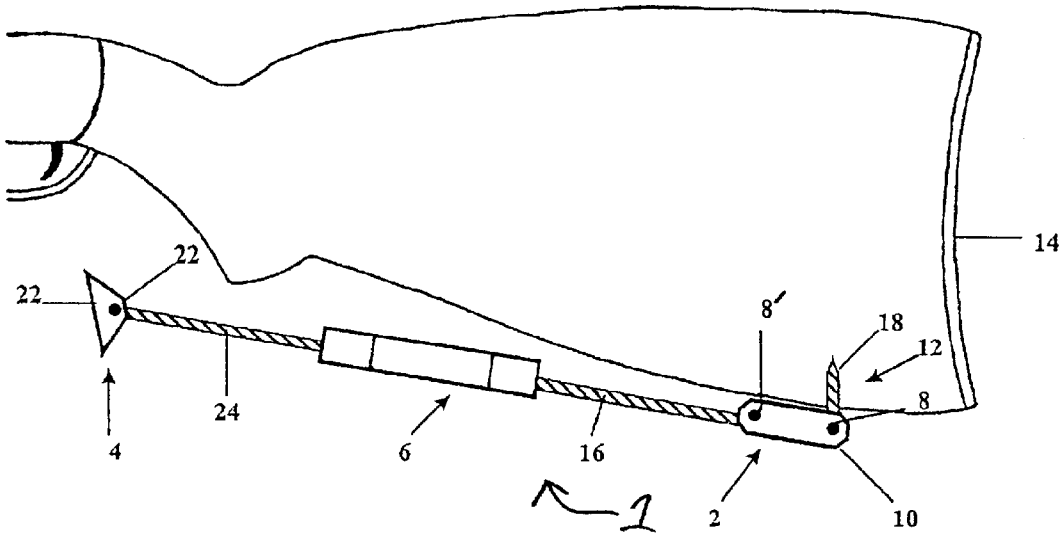
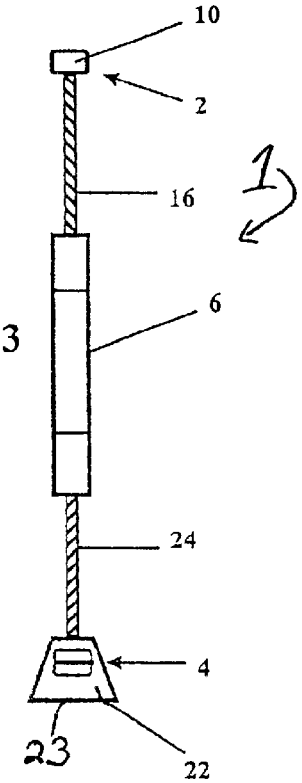
Figure 3
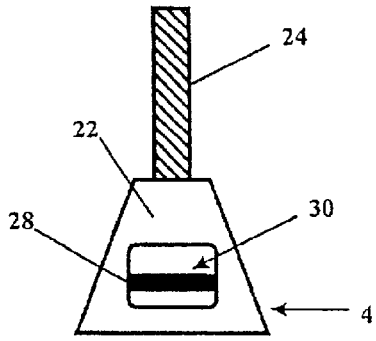
Figure 4

FIREARM LEVELER AND STABILIZER

This application claims priority of prior provisional application Ser. No. 60/212,110, filed Jun. 15, 2000, entitled "Firearm Leveler and Stabilizer," which is incorporated herein by this reference.

BACKGROUND OF THE INVENTION

1. Field of the Invention

This invention relates to guns and gun supports. Specifically, the device relates to rifle stabilization and leveling equipment for increased accuracy and safety, and for reducing a gun user's fatigue.

2. Related Art

A number of gun stabilizing devices exist for increasing projectile accuracy. These devices typically include a leg connected to the firearm stock about midway along the firearm length and extending down from the firearm to the ground or floor. These devices are intended to stabilize the firearm during targeting or firing. Noteworthy examples of the prior art include:

Helmstadter (U.S. Pat. No. 4,007,554) is an ADJUSTABLE GUN SUPPORT that includes a cradle that receives a front portion and a rear portion of the gun, and a pointed rod member which is inserted in the ground with the aid of a step-on member. The gun cradle may be raised or lowered vertically on the rod to elevate or lower the rifle.

The GUN REST proposed by Pickett (U.S. Pat. No. 4,393,614) depicts a mono-pod attached by a clamp to a rifle barrel at a position forward of the fore-stock. The leg of the monopod telescopes for raising or lowering the rifle barrel. The monopod pivots to be generally parallel to the rifle barrel for storage and pivots to be generally perpendicular to the barrel for stabilization of the rifle barrel. A user of this GUN REST collapses the telescoping leg for storage and resets the length of the telescoping leg when re-using the monopod after storage.

Brown (U.S. Pat. No. 5,345,706) also describes a telescoping FIREARM SUPPORT that attaches to a rifle's fore-stock using a bolt located forward of the receiver.

Brubach (U.S. Pat. No. 5,903,995) adds a base plate to a mono-pod device.

Harris (U.S. Pat. No. 4,625,620) describes a BIPOD FOR A FIREARM which attaches to the forestock and has a pair of adjustable telescoping legs. The bipod legs maintain a strut mechanism with resilient properties for absorbing recoil forces.

Another category of gun support systems include more complex systems than most mono-pod or bi-pod systems, resulting in what may be called a cradle or a support frame with several legs. Cady (U.S. Pat. No. 4,026,057) SHOOTING SUPPORT FOR RIFLE and Cady (U.S. Pat. No. 5,628,135) SHOOTING SUPPORT FOR RIFLES AND HANDGUNS are exemplary of art in this category. These two devices provide a mechanical support mechanism that cradles the weapon upon a base that has both pivotal front support legs and a rear leg support. These stands may adjust to a number of positions that accommodate varying terrain and facilitate transport.

Buttstock rests are a third category of rifle stabilizers. Lombardo (U.S. Pat. No. 4,987,694) discloses a GUN REST FOR CONTROLLING THE BUTTSTOCK that has a U-shaped bracket that receives the butt of the gun stock. The U-shaped bracket terminates in a base member. It rigidly attaches to the butt vertical end surface. The device provides a mechanism to adjust buttstock elevation and a dampening pad reduces recoil forces.

Beltz (U.S. Pat. No. 5,937,560) is an ADJUSTABLE FIRE ARM SUPPORT that attaches to a sling stud mounted on the underside of a buttstock. A top end of a support rod has a pivotal clasp that engages the sling stud. A support leg can be rotated up or down on the lower threaded end of the support rod.

SUMMARY OF THE INVENTION

The present invention is a FIREARM LEVELER AND STABILIZER, hereafter also referred to as the "leveler-stabilizer," that reduces rifle movement to improve shot groupings or accuracy and/or assists in leveling the rifle for precise aim or comfort. The leveler-stabilizer provides a rear support leg that, when used in conjunction with a front bi-pod, provides a simple, yet stable system that can also reduce fatigue of the user during aiming and waiting for the desired shot.

The leveler-stabilizer comprises preferably a single adjustable elongated member, that is preferably used along with a front support of some type, but that is not connected to the front support. The leveler-stabilizer has an adjustment system for lengthening or shortening the elongated member that features extremely fine-adjustment or "fine-tuning." Most-preferably, the adjustment system comprises a turnbuckle.

The preferred leveler-stabilizer is a simple and effective device that, with a minimum of parts, addresses the need for a compact and reliable leveling and stabilizing device) especially for the rear end of the gun. The leveler-stabilizer includes, on one end, a pivotal connector that connects or attaches to the bottom surface of a rear portion of a gun, preferably to the bottom of the butt of the gun. The leveler-stabilizer includes, on its other end, a foot pad for resting on the ground or other surface. Between the connector and the foot pad is preferably an elongated leg comprising a single turnbuckle. The turnbuckle provides an adjustment means for extremely precise height-adjustment and leveling of the firearm. Also, the foot pad rests upon a supporting surface to support the firearm, and, when used with a bi-pod, to create a three-leg support system that allows the user to rest his arms rather than support the firearm for long periods of time while aiming and waiting. During the shot, the invented leveler-stabilizer increases stability during recoil.

The preferred device is constructed from three main components: a connector, a turnbuckle assembly, and a lower assembly. The preferred connector is a swivel assembly that is adapted to pivotally connect to a rear portion of a firearm. Preferably, the swivel assembly connects to a sling mount, such as a sling stud, which is often already provided on a gun buttstock for receiving one end of a gun sling.

The turnbuckle comprises two oppositely threaded ends that rotate on their axis in the turnbuckle body. One threaded rod of the turnbuckle assembly is connected to the swivel assembly, and the other oppositely-threaded rod of the turnbuckle assembly is connected to the lower assembly. The turnbuckle body connects, and is generally centrally located between, the two threaded ends.

The lower assembly comprises a foot pad that is pivotally connected to the lower end of the turnbuckle, that is, the lower threaded rod. The foot pad may have an optional sling attachment point, such as a sling eyelet, or similar opening, that allows a sling to be attached to the leveler-stabilizer instead of to the sling stud.

The invented device's assembly may vary according to the equipment already placed upon the firearm. The most demanding installation will require placement of a sling mount onto or into the buttstock of a rifle or handgun. A swivel assembly with an attached turnbuckle is then attached to the sling mount. The swivel assembly preferably is pivotal at its point of connection to the sling mount and/or the top threaded rod of the turnbuckle. The swivel assembly may be integrally connected to the sling mount during manufacture.

The swivel assembly and the lower assembly are connected by the turnbuckle, and the turnbuckle is adjusted using clockwise and counterclockwise movements of the turnbuckle body about its axis. The clockwise or counterclockwise movement will depend on the direction of the male threading of the rods and the female threading of the turnbuckle. For example, the threading of the top rod may be right-threaded and the lower rod left-threaded, or, the threading may be reversed with the right-threaded rod attached to the lower assembly and the left-threaded rod attached to the swivel assembly.

The fully-assembled firearm leveler and stabilizer provides a means to rapidly adjust the elevation of the buttstock to sight a target. The rods and turnbuckle are pivoted to a generally perpendicular position relative to the longitudinal axis of the firearm, and the base of the foot pad is positioned parallel to a generally stable and planar surface. A bi-pod or other support is placed under the front of the firearm, so that the firearm is supported near both ends by two, preferably independently-adjustable supports. A gross adjustment typically is made before the firearm is set up on the bi-pod and the lever-stabilizer, followed by fine-tuning of the height of the buttstock by turning the turnbuckle clockwise or counterclockwise. A particularly beneficial feature of the invented leveler-stabilizer is that extremely accurate height-adjustment/leveling may be made after setting up the firearm in position for firing. The user may look through the scope at the target, for example, while adjusting the turnbuckle with one hand, and letting the other hand rest. The turnbuckle may be smoothly and slowly turned for very small adjustments, which assists in establishing very accurate projection upon firing.

When the user is done shooting, the leveler-stabilizer may be pivoted against the gun for storage or a sling may be attached to the leveler-stabilizer for carrying the combined gun plus leveler-stabilizer. The leveler-stabilizer stores parallel to the buttstock without necessarily any shortening of its length, which means that frequently the lever-stabilizer may be rapidly deployed again in a generally pre-adjusted state in similar physical environs, so that little or no fine-tuning is required.

The leveler-stabilizer advances the art of firearm use by (1) doubling the speed of stabilized buttstock elevation compared to a single-threaded device by providing a "double-threaded"adjustment (such as a turnbuckle), (2) requiring a minimal amount of attachment to the firearm itself and (3) providing for unintrusive storage and rapid deployment.

BRIEF DESCRIPTION OF THE DRAWINGS

FIG. 2 is a side view of the leveler-stabilizer of FIG. 1, without an exterior sling attachment point, pivoted into a generally-horizontal storage position.

FIG. 3 is a front view of another embodiment of the leveler-stabilizer having a recessed sling attachment point.

FIG. 4 is a front view of the detail of the lower assembly of the embodiment in FIG. 3.

DETAILED DESCRIPTION OF THE INVENTION

Referring to the Figures, there are shown several, but not the only, embodiments of the leveler-stabilizer 1. The preferred embodiment comprises a swivel assembly (2), a lower assembly (4) and a turnbuckle (6).

Figure 1:
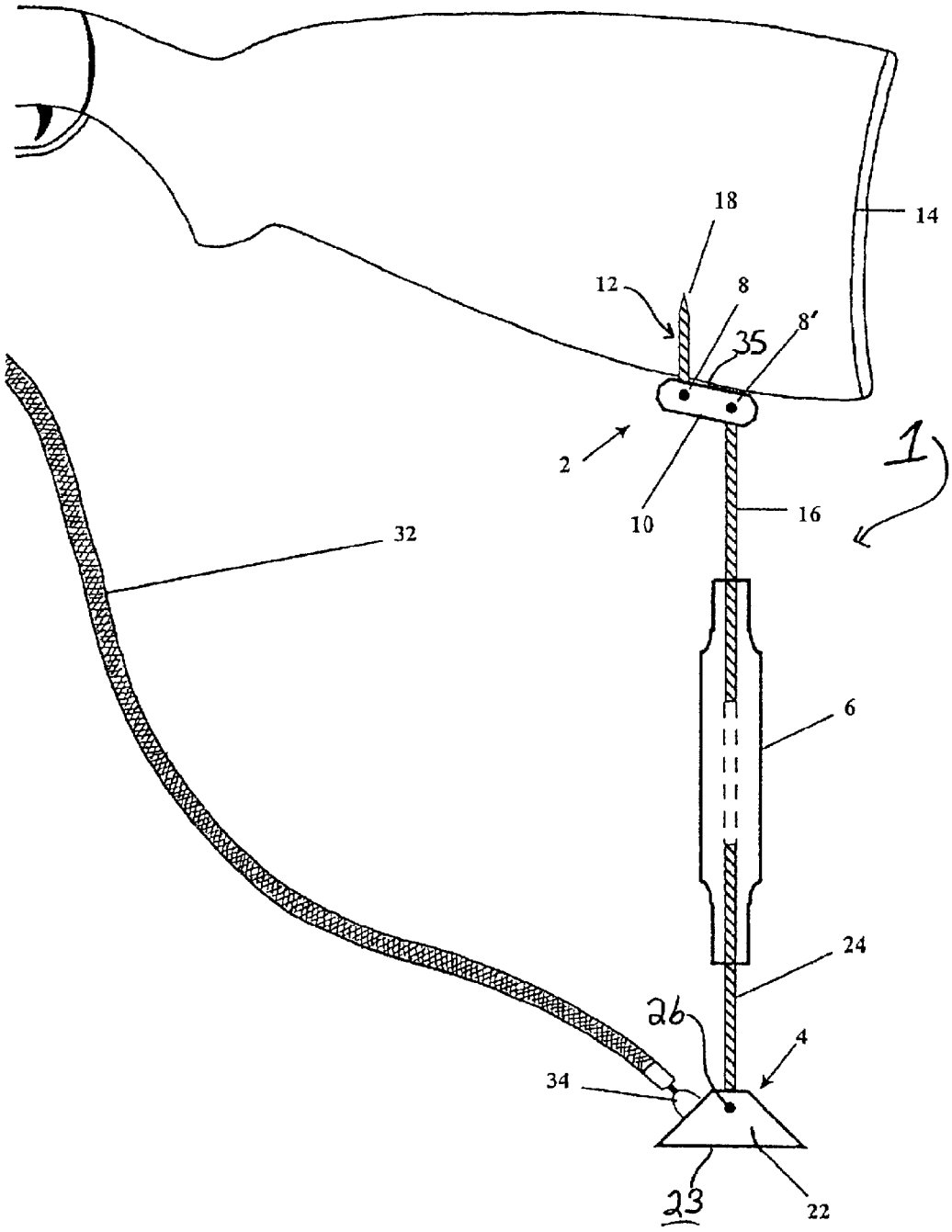
FIG. 1 is a schematic side view of one embodiment of the leveler-stabilizer that includes an exterior sling attachment point on the foot pad of the leveler-stabilizer.

The swivel assembly (2) has two pins (8, 8') in a swivel (10), as depicted in FIGS. 1 and 2. FIG. 1 illustrates the leveler-stabilizer 1 in its extended, generally vertical position ready for use. The first pin (8) interconnects with a sling stud or mount (12) to make the swivel (10) pivotal relative to the buttstock (14). For example, pin 8 may pass through an, aperture in the sling mount 12 (aperture not shown). As suggested in FIG. 2, which shows the leveler-stabilizer 1 pivoted for storage or travel, the pivotal nature of this connection allows the swivel (10), actually, the leveler-stabilizer 1 as a whole, to pivot to be generally parallel, and in close proximity, to the buttstock. The second pin (8') interconnects the swivel (10) with a male, right-threaded rod (16) and allows this rod (16) to pivot to be parallel and close to the buttstock.

The sling mount (12) may include a threaded protrusion (18) that screws into the buttstock 14 (or, less-preferably, to a butt plate at the end of the butt). Optionally, the sling mount (12) may be integrated into the buttstock (or butt plate) during manufacture of the firearm. Other sling mount embodiments may use different attachment mechanisms including hook and loop fasteners, cotter pins, welded protrusions or plates, etc. to connect the swivel (10) to the buttstock 14.

The lower assembly (4) includes a foot pad (22) that interconnects with a male, left-threaded rod (24) by means of a third pivotal pin (26). Foot pad (22) is preferably generally trapezoidal or pyramid-shaped, with a base (23) approximately 1–5" wide X 1–3" deep. The foot pad (22) height (extending up from the base) is minimal to reduce the weight of the overall device but will depend on provisions for a sling attachment point. The pivotal nature of the connection by pivotal pin (26) permits the foot pad to rotate relative to the left threaded rod (24) when the foot pad is placed upon a slanted planar surface. An optional pin (28) may be recessed within a concave well (30) on the front portion of the foot pad to accommodate attachment of a carrying sling (32). An eyelet (34) affixed to the exterior surface of the same area may serve a similar purpose.

Turnbuckle body (6) has female right- and left-threading, and rotates about its axis to accept the right threaded rod (16) and the left threaded rod (24) at opposite ends of the body (6). By rotating the turnbuckle body (6) in a first direction, the threaded rods (16) and (24) are pulled into the body (6), shortening the total length of the leveler-stabilizer 1. By rotating the turnbuckle body (6) in the opposite direction, the threaded rods (16) and (24) are pushed apart, lengthening the total length of the leveler-stabilizer 1.

Production of the swivel assembly, lower assembly, and other parts of the invented device may utilize stamping, forging, injection, welding, molding and/or machining process techniques, as will be apparent to one of average skill after seeing this disclosure. Utilizing carbon fiber or similar lightweight high-strength materials with pre-molded or cut-out threading may address any weight concerns. The use of metal(s), non-metal(s), composite materials, metal alloys and/or polymeric materials, such as high impact plastics or carbon fibers, may be utilized to construct the device.

The invention has two general positions that may generally be called horizontal and vertical. The preferred position for use is actually extending slightly rearward from the connection point to the buttstock (see FIG. 7A). This way, the firearm is more stable, especially against the user bumping the firearm while waiting and against recoil during the shot. In a horizontal position, the swivel (10) rotates clockwise by pivoting on first pin (8). At a point in time before, during or after the swivel rotation, the right threaded rod (16), turnbuckle body (6), left threaded rod (24) and foot pad (22) also rotate toward the forestock around second pin (8'). Thus, this swivel assembly comprises two pivot points or pivot joints.

Figure 5:
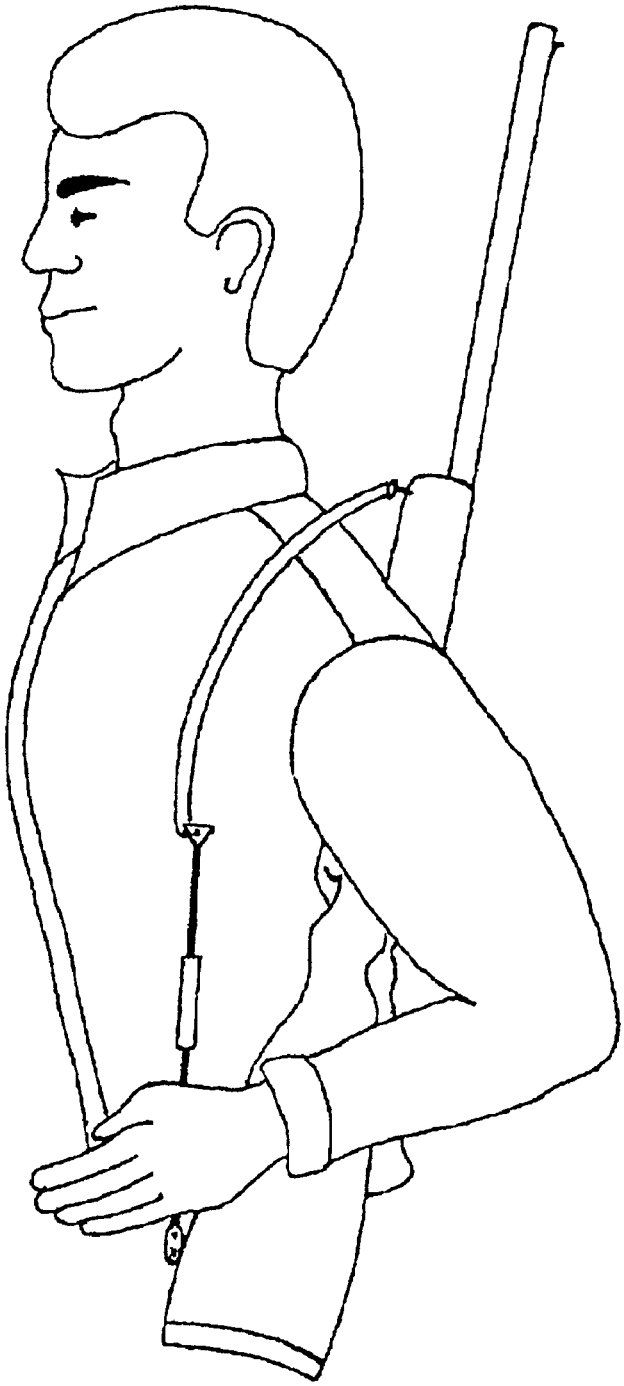
FIG. 5 is a side view of an embodiment of the leveler-stabilizer connected to a rifle and a sling and being carried by a user.

The leveler-stabilizer will generally rest parallel with the firearm barrel when used in conjunction with a carrying sling, shown in FIG. 5. This positioning accommodates the sling as it extends around the arm and shoulder of the user. The leveler-stabilizer 1 preferably may rotate all the way to a position wherein it is contacting the lower plane of the firearm's buttstock (14) at least at points along the length of the leveler-stabilizer. The stored position of the leveler-stabilizer against the buttstock permits storage of the firearm in a gun rack or similar container without removal of the leveler-stabilizer.

The device's vertical position places a first surface (35) of the swivel (10) against the buttstock (14) with the right threaded rod (16) extending downward from the swivel. This positioning generally places the device's rod-turnbuckle axis in a perpendicular orientation to the firearm's barrel. The invented single-leg, turnbuckle-style leveler-stabilizer allows accurate adjustment while also providing a rigid "leg" upon which the firearm is supported and which is used as a raising device or lowering device which pivots the firearm on its front pivot point, which is the front pod unit 200 (mono-pod, bi-pod, or other). Frictional forces within the turnbuckle prevent unintentional, accidental movement of the turnbuckle. This vertical position permits the turnbuckle to rotate and adjust the elevation of the firearm's barrel for targeting. Importantly, this adjustment does not require movement of the foot pad (22) and allows the gunman to adjust the elevation without movement of the firearm, that is, while the foot pad is firmly and surely in place. The use of a forestock support such as a monopod, bipod, sandbags, etc. may enhance the foot pad stabilization and provide even greater projectile accuracy, as shown in FIG. 7A.

Figure 6:
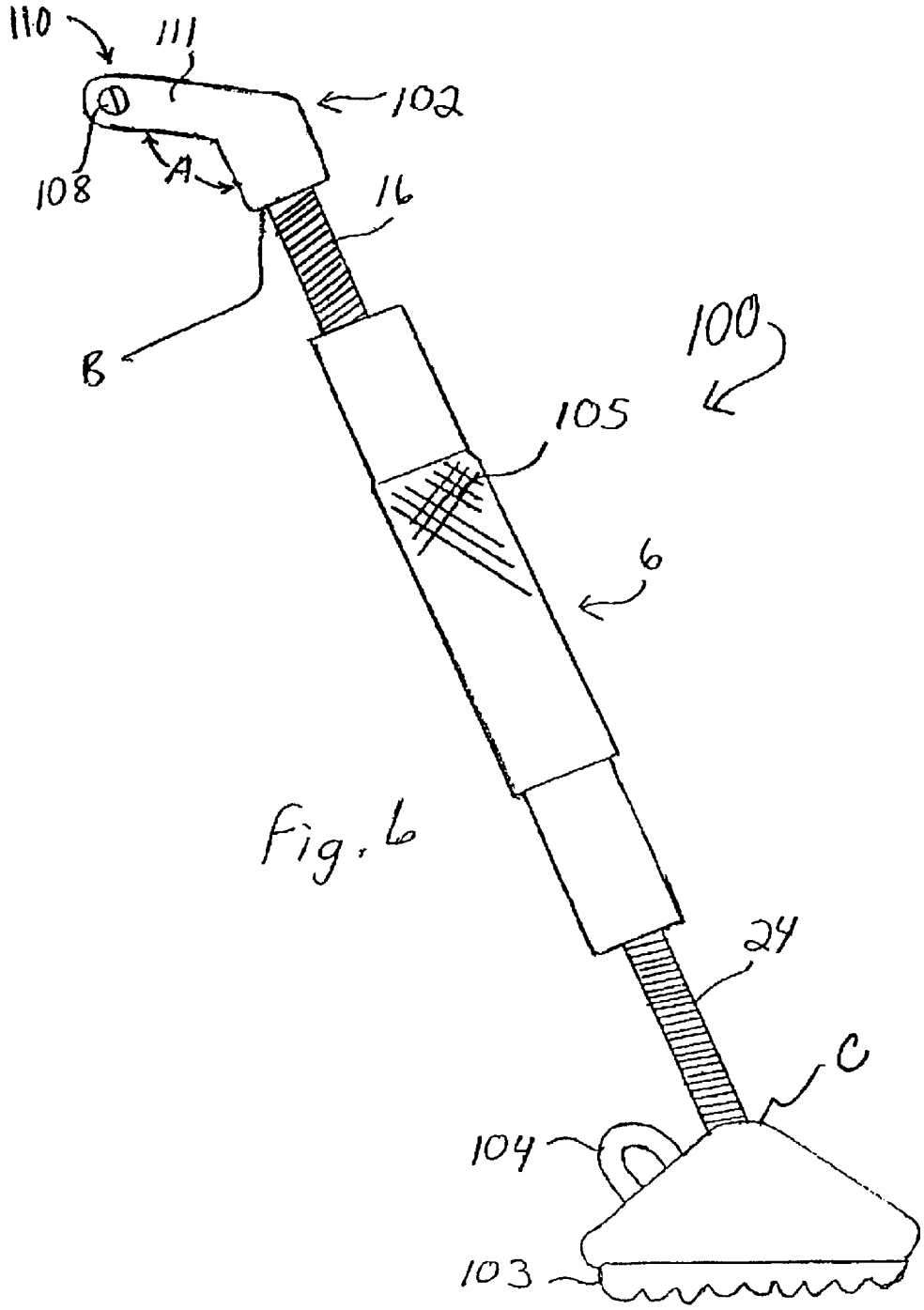
FIG. 6 is a side view of another, especially-preferred embodiment, with a modified connector.
Figure 7A:
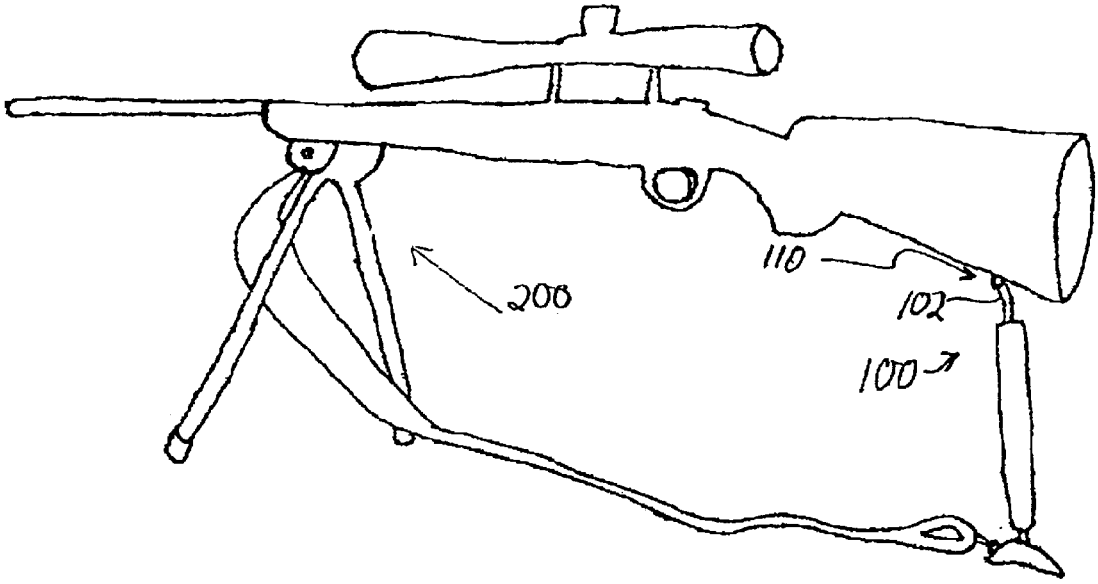
FIG. 7A illustrates a leveler-stabilizer of the type in FIG. 6 in use with a bi-pod near the front of the gun.
Figure 7B:
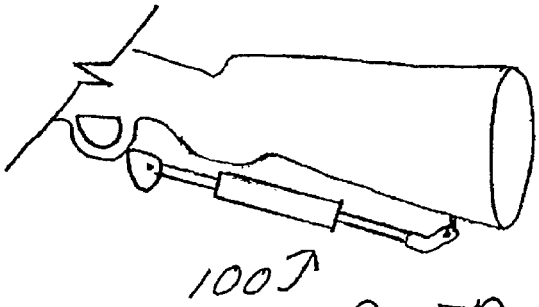
FIG. 7B illustrates a leveler-stabilizer of the type in FIG. 6 stored against the gun during non-use.

FIGS. 6, 7A, and 7B illustrate an especially-preferred embodiment of the leveler-stabilizer 100, which includes a modified swivel assembly 102, a rubbery pad or otherwise gripping surface 103 on the bottom of the foot pad, a sling mount 104, and etching or other frictional enhancement 105 on the turnbuckle body (6). The swivel assembly 102 comprises a swivel (110) that utilizes a single top pivot point 108, which pivots relative to the sling stud or sling mount 12. A bolt or pin extends through the sling mount 12, and the swivel (110) pivots to place the leveler-stabilizer 100 in a generally vertical (but preferably somewhat rearward-reaching) position, as shown in FIG. 7A. When the leveler-stabilizer 100 is stored, it pivots at the single top pivot point 108, which may also be called a single pivot joint of the swivel.

Figure 7C:
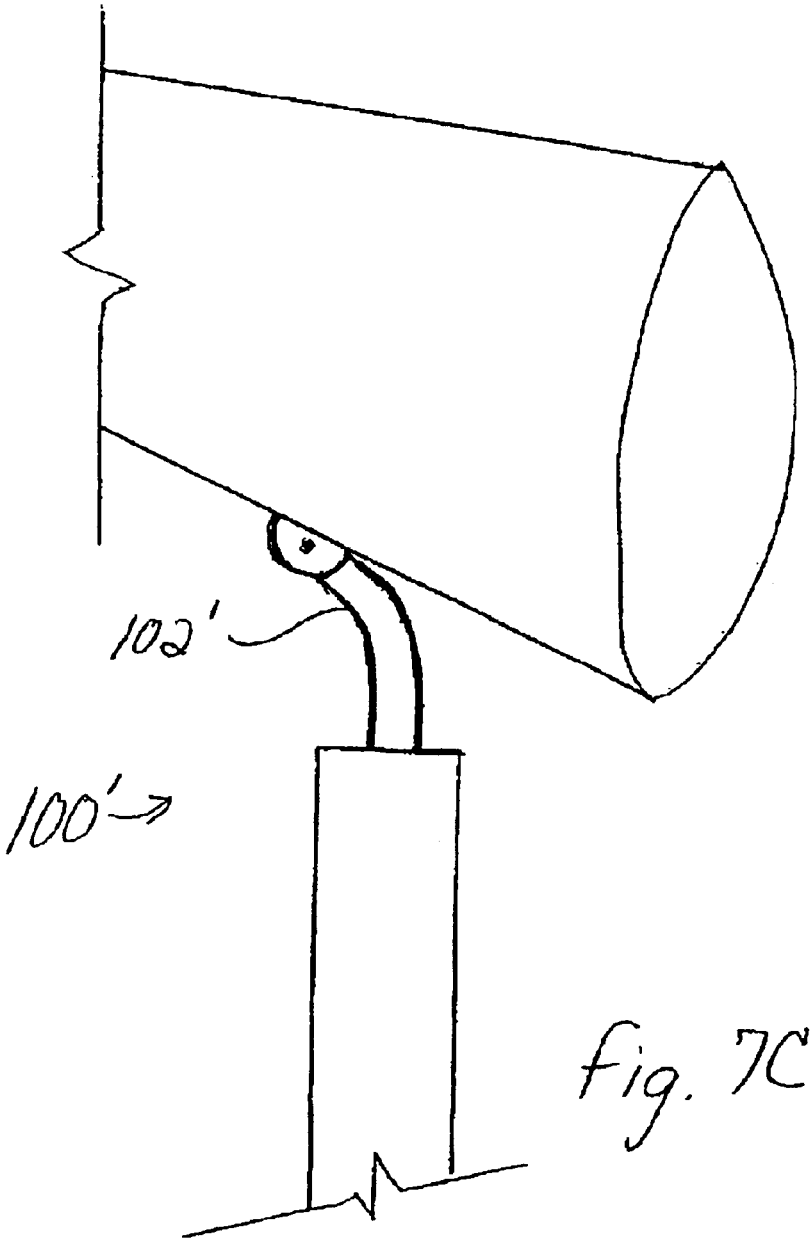
FIG. 7C illustrates a leveler-stabilizer of the type in FIG. 6 having a curved arm.

The especially-preferred swivel (110) comprises an arm (111) that extends from its fixed connection with top rod (16) at an angle to the longitudinal axis of the leveler-stabilizer 100, to place the pivot point (108) a distance from the axis of the leveler-stabilizer 100. The arm extends preferably about one inch (or preferably in the range of about 1–2 inches) from the axis at an angle of about 40 degrees (preferably in the range of about 30–50) to the rod (16). See angle A in FIG. 6. This way, when the swivel 110 pivots for storage, there is clearance for the leveler-stabilizer 100. As shown in FIG. 7C, a level-stabilizer 100' may have a swivel assembly 102' with a curved arm.

The invented leveler-stabilizer is particularly effective because it is preferably simple in construction and use. It may consist of as few parts as the swivel assembly (with one pivot bolt or pin) non-rotatable and non-pivotally attached (at "B") to the top rod, the lower rod pivotally but non-rotatably attached (at "C") to the foot pad (with preferably a gripping surface), and a turnbuckle body connecting the top and lower rod.

Although this invention has been described above with reference to particular means, materials and embodiments, it is not limited to these disclosed particulars and extends to all equivalents within the scope of the following claims.

I claim:

1. An adjustable firearm leveler, comprising:

an elongated member adapted to extend down from a firearm, the elongated member including:

a connector assembly adapted to pivotally connect to the firearm;

a base member adapted for placement on a support surface;

a turnbuckle extending between and adjustably connecting the connector assembly to the base member; and a sling mount coupled to the base member, and designed to connect to one end of a firearm sling.

2. The device of claim 1, wherein the connector assembly comprises a single pivot joint.

3. The device of claim 1, wherein the connector assembly comprises two pivot joints, so that the connector assembly pivots relative to the firearm and the connector also pivots relative to the turnbuckle.

4. The device of claim 1, wherein the turnbuckle has two oppositely-threaded end rods and a central body adapted to be turned relative to the end rods to shorten and lengthen the elongated member.

5. The device of claim 1, wherein the elongated member is positioned on a butt end of the firearm.

6. The device of claim 1, wherein the connector assembly comprises an angled arm that forms an angle to the elongated member.

7. The device of claim 6, wherein the angled arm is angled sufficiently to rest the angled arm on a stock of the firearm when the elongated member is positioned substantially in a downward direction from the firearm.

8. An adjustable leveler for a firearm, comprising:

a connector assembly, coupled to one end of the leveler, and adapted to pivotally connect the leveler to the firearm;

a base member, coupled to another end of the leveler, and adapted for placement on a support surface;

a turnbuckle adjustably coupled between the connector assembly and the base member; and a sling mount coupled to the base member, designed to connect to one end of a firearm sling.

9. The adjustable leveler of claim 8, wherein the turnbuckle has two oppositely-threaded end rods and a central body adapted to be turned relative to the end rods to shorten and lengthen the adjustable leveler.

10. The adjustable leveler of claim 9, wherein the connector assembly comprises an angled arm that is angled sufficiently to rest the angled arm on a stock of the firearm when the adjustable leveler is positioned substantially in a downward direction from the firearm.

* * * * *

UNITED STATES PATENT AND TRADEMARK OFFICE

CERTIFICATE OF CORRECTION

PATENT NO. : 6,772,549 B2
DATED : August 10, 2004
INVENTOR(S) : Todd J. Muhlestein It is certified that error appears in the above-identified patent and that said Letters Patent is hereby corrected as shown below:

Title page,
Item [57], ABSTRACT,
Line 7, "recoil, and while the front" should read -- recoil, while the front --
Line 14, "pivots to against the" should read -- pivots against the --

Column 2,
Line 29, "stabilizing device)" should read -- stabilizing device --

Column 4,
Line 26, "an, aperture in the sling" should read -- an aperture in the sling --

Signed and Sealed this

Eighteenth Day of January, 2005

JON W. DUDAS
*Director of the United States Patent and Trademark Office*